US006887033B1

(12) United States Patent
Phillips et al.

(10) Patent No.: US 6,887,033 B1
(45) Date of Patent: May 3, 2005

(54) COOLING SYSTEM FOR NOZZLE SEGMENT PLATFORM EDGES

(75) Inventors: James Stewart Phillips, Easley, SC (US); Edward Lee McGrath, Easley, SC (US); Robert Carl Meyer, Simpsonville, SC (US); Gerald Kent Blow, Greer, SC (US); Jennifer Ann Morrow, Tehachapi, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/703,575

(22) Filed: Nov. 10, 2003

(51) Int. Cl.[7] ..... F04D 29/58
(52) U.S. Cl. ..... 415/115; 415/116; 416/96 R; 416/96 A; 416/97 R
(58) Field of Search ..... 415/115, 116; 416/96 R, 416/96 A, 97 R

(56) References Cited

U.S. PATENT DOCUMENTS 3,433,015 A * 3/1969 Sneeden ..... 415/115
3,610,769 A * 10/1971 Schwedland et al. ..... 415/115
3,628,880 A * 12/1971 Smuland et al. ..... 416/97 R
4,017,213 A * 4/1977 Przirembel ..... 416/97 A
4,244,676 A * 1/1981 Grondahl et al. ..... 416/96 R
5,122,033 A * 6/1992 Paul ..... 416/96 R
6,572,335 B2 * 6/2003 Kuwabara et al. ..... 416/97 RE

* cited by examiner

*Primary Examiner*—Edward K. Look
*Assistant Examiner*—Igor Kershteyn
(74) *Attorney, Agent, or Firm*—Nixon & Vanderhye

(57) ABSTRACT

The cooling system for the nozzle edges includes a chamber containing a cooling medium. First and second elongated plenums are disposed along opposite side edges of each platform. Inlet passages communicate cooling medium from the chamber into each plenum. Outlet passages from each plenum terminate in outlet holes in the side edges of the platform to cool the gap between adjacent nozzle segments. Passageways communicate with each plenum and terminate in film cooling holes to film cool platform surfaces. In each plenum, the inlet passages are not in direct line-of-sight flow communication with the outlet passages and passageways.

18 Claims, 6 Drawing Sheets

COOLING SYSTEM FOR NOZZLE SEGMENT PLATFORM EDGES

BACKGROUND OF THE INVENTION

The present invention relates generally to a cooling system for the nozzle segments of a gas turbine and particularly relates to a cooling system for cooling the adjoining edges of inner and outer platforms of adjacent nozzle segments arranged in an annular array about the axis of the turbine.

In gas turbines, annular arrays of nozzles are disposed in the hot gas path for turning and accelerating the gas flow for optimum performance of the buckets. In the first stage of a turbine, for example, there are a plurality of circumferentially spaced nozzle vanes which extend generally radially between inner and outer annular bands which serve to confine the gas flow to an annular configuration as the gas flows through the multiple stages of the turbine. A plurality of circumferentially spaced buckets mounted on the turbine rotor lie axially downstream of the annular array of nozzles and form a turbine stage with the nozzles. The nozzles, for example, of the first stage of the turbine, are typically provided in nozzle segments. Each nozzle segment includes an inner platform and an outer platform and at least one vane extending between the platforms. The nozzle segments are arranged in circumferential registration with one another. Particularly, the inner and outer platforms of each nozzle segment lie in circumferential registration with the inner and outer platforms of adjacent segments, respectively. In this arrangement, gaps are formed between adjoining segments along the platform edges. Prior nozzle platform edges have been uncooled, cooled by film cooling from adjacent nozzle segments or cooled by long holes that run from a large impingement cavity in the nozzle segment to the gaps between the nozzle segments. Film cooling from an adjacent nozzle to cool the platform edge, however, causes a debiting of the cooling effectiveness when the cooling film crosses the nozzle intersegment gap. When long holes running from an impingement cavity are utilized, the convective cooling of the edge by the holes is discrete rather than continuous and, therefore, less efficient.

Certain prior nozzle designs have adjacent platform edges configured such that the nozzle intersegment gaps are aligned parallel to the hot gas flow vector. Perfect alignment of the adjoining edges of the nozzle segments, however, is difficult to achieve and maintain as a result of manufacturing and thermomechanical problems. It will be appreciated that the core flow boundary layers of the hot gas along the platform surfaces may be tripped if the intersegment gap is not aligned with the flow direction. A boundary layer trip at the adjoining edges of the platforms results in a spike in heat transfer near the edge of the platform and also results in a debit to the cooling effectiveness of any film cooling medium that crosses the gap.

Notwithstanding the desirability of aligning the inner segment gaps parallel to the flow vector, it is beneficial for other reasons to provide nozzle platform edges which extend generally parallel to the axis of the rotor. This enables removal of the nozzles without removal of the top half of the turbine shell, resulting in less expensive and more flexible maintenance. Consequently, the intersegment gap is not aligned with the core flow downstream of the vane. Such design is more sensitive to any platform deformations that would cause a mismatch between the platform edges of adjacent nozzle segments and cause the core flow to "see" a facing step. Thus, the edges of nozzles segment platforms which extend generally parallel to the turbine axis are subject to severe thermal distress due to boundary layer trip. Accordingly, it has been found desirable to provide a cooling system which would minimize or eliminate the foregoing problems associated with cooling edges of nozzle segments wherein the edges lie generally parallel to the turbine axis.

BRIEF DESCRIPTION OF THE INVENTION

In accordance with a preferred embodiment of the present invention, an elongated plenum is provided along at least one edge and, preferably, both edges of each of the inner and outer platforms. Each plenum is provided with a plurality of supply or inlet passages in communication between a source of a cooling medium, e.g., compressor discharge air. The supply passages communicate with the elongated plenum at spaced locations along the plenum. A plurality of outlet passages are provided in communication with each plenum at spaced locations therealong and have outlet openings through a corresponding side edge of the platform at spaced locations therealong. Additional passageways lie in communication with the plenum and terminate in a plurality of film cooling holes in the platform surface exposed to the hot gas path. Thus, cooling medium supplied from the plenum to the film cooling holes film cool the platform surfaces exposed in the hot gas path.

The outlet passages and passageways from each plenum are located such that each inlet passage does not have direct line-of-sight to the outlet passages and passageways. As a consequence, the cooling medium impinges on the walls of each plenum and provides additional internal convective cooling to the edges of the platform. Moreover, the cooling medium supply passages provide a substantially uniform pressure and flow of coolant along the length of the plenum, affording a continuous rather than discrete cooling effect. As a consequence of this arrangement, the edges of the platforms are cooled by (i) both conduction and convection due to the proximity of the plenum to the edge being cooled; (ii) cooling medium flowing through the outlet passages passing under the edge and into the intersegment gap through the outlet openings; (iii) impingement of the supplied cooling medium inside the plenum due to the lack of direct line-of-sight flow from the inlets to the outlets; and (iv) film cooling.

In a preferred embodiment according to the present invention, there is provided a nozzle segment for a turbine having an axis, comprising inner and outer platforms and at least one nozzle vane extending therebetween, the platforms having side edges extending generally parallel to the axis, a cooling system for at least one of the platforms including a source of a cooling medium, a first elongated plenum extending along at least one of the side edges of the one platform, a plurality of inlet passages in communication between the source and the plenum at spaced locations along the plenum, a plurality of outlet passages in communication with the plenum at spaced locations along the plenum and having outlet openings through one side edge of one platform at spaced locations therealong, and passageways in communication with the plenum and a plurality of film cooling holes disposed along a surface of one platform for supplying the cooling medium along and film cooling the platform surface, the inlet passages, the outlet passages and the passageways being arranged such that the inlet passages do not have direct line-of-sight flow of the cooling medium into the outlet passages and the passageways.

In a further preferred embodiment according to the present invention, there is provided in a turbine having an axis, a plurality of nozzle segments arranged in a circumferential array about the axis, each of the nozzle segments including inner and outer platforms and at least one nozzle vane extending therebetween, the platforms having side edges extending generally parallel to the axis and in generally circumferential registration with the side edges of platforms of adjacent nozzle segments, a cooling system for at least one of the platforms of each segment including a source of a cooling medium, a first elongated plenum extending along at least one of the side edges of one platform, a plurality of inlet passages in communication between the source and the plenum at spaced locations along the plenum, a plurality of outlet passages in communication with the plenum at spaced locations along the plenum and having outlet openings through one side edge of one platform at spaced locations therealong for flowing the cooling medium toward the side edge of a platform of an adjacent nozzle segment, and passageways in communication with the plenum and a plurality of film cooling holes disposed along a surface of the platform for supplying the cooling medium along and film cooling the platform surface, the inlet passages, the outlet passages and the passageways being arranged such that the inlet passages do not have direct line-of-sight flow of the cooling medium into the outlet passages and the passageways.

In a further preferred embodiment according to the present invention, there is provided a nozzle segment for a turbine having an axis, comprising inner and outer platforms and at least one nozzle vane extending therebetween, the platforms having opposite side edges adjacent respective suction and pressure sides of the vane, a cooling system for at least one of the platforms including a source of a cooling medium, first and second elongated plenums extending along the opposite side edges of one platform, a plurality of first and second inlet passages in communication between the source and the first and second plenums, respectively, at spaced locations therealong, a plurality of first and second outlet passages in communication with the first and second plenums, respectively, at spaced locations along the plenums and having outlet openings through respective opposite side edges of one platform at spaced locations therealong, and a plurality of first and second passageways in communication with the first and second plenums, respectively, and a plurality of film cooling holes disposed along a surface of one platform for supplying the cooling medium along and film cooling the platform surface, the first and second plenums extending along respective side edges of the platform adjacent suction and pressure sides of the vane with the first plenum spaced closer to a side edge of the platform on the suction side of the vane than the second plenum is spaced from the side edge of the platform on the pressure side of the vane.

DETAILED DESCRIPTION OF THE INVENTION

Figure 1:
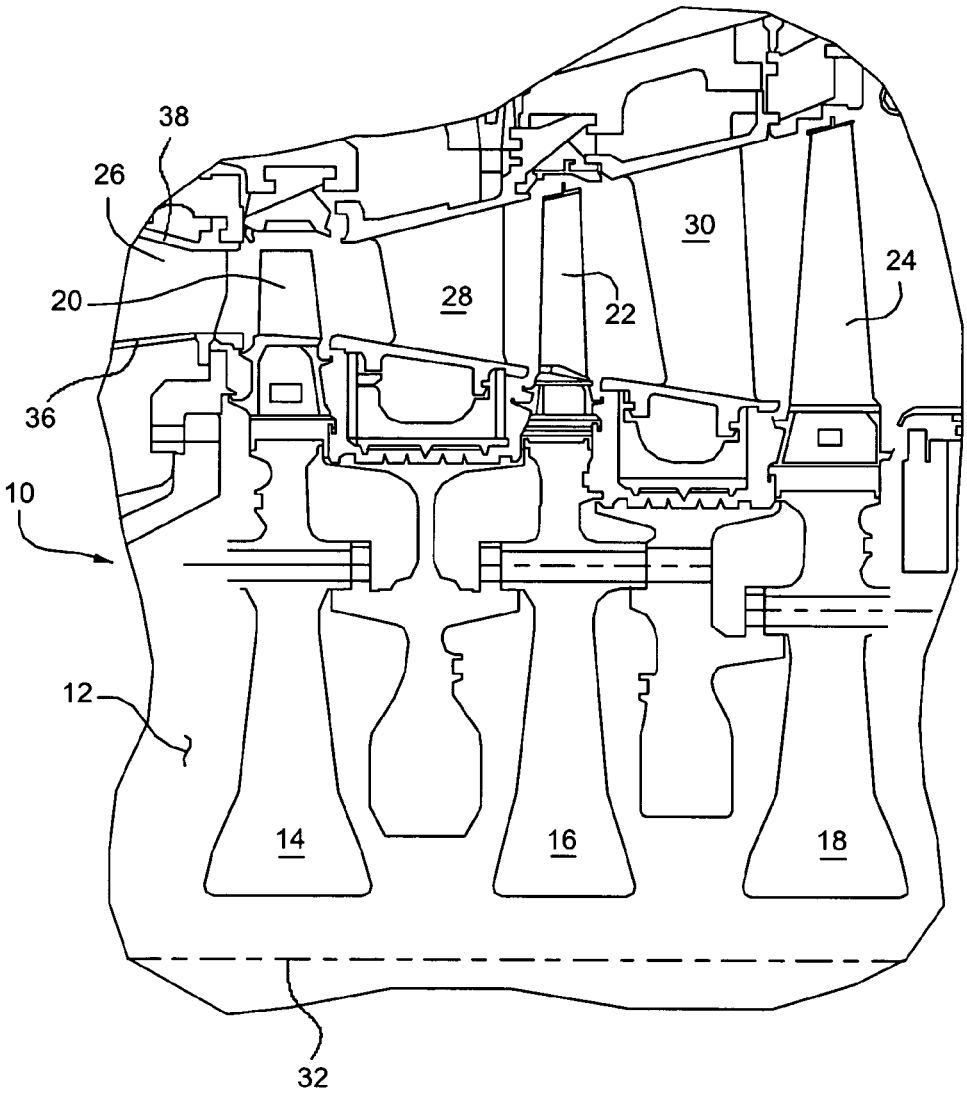
FIG. 1 is a schematic fragmentary view of a portion of a three-stage turbine incorporating a nozzle segment platform edge cooling system in a stage one nozzle in accordance with a preferred embodiment of the present invention.

Referring now to the drawings, particularly to FIG. 1, there is illustrated a multi-stage turbine section, generally designated 10, including a rotor 12 having rotor wheels 14, 16 and 18. The rotor wheels 14, 16 and 18 mount buckets 20, 22 and 24, respectively, in the hot gas path of the turbine. The first, second and third nozzle stages are likewise illustrated and represented by the nozzle vanes 26, 28 and 30, respectively. It will be appreciated that the nozzle vanes 26, 28 and 30 turn and accelerate the hot gases to rotate the buckets and rotor about the axis 32 of the turbine.

Figure 2:
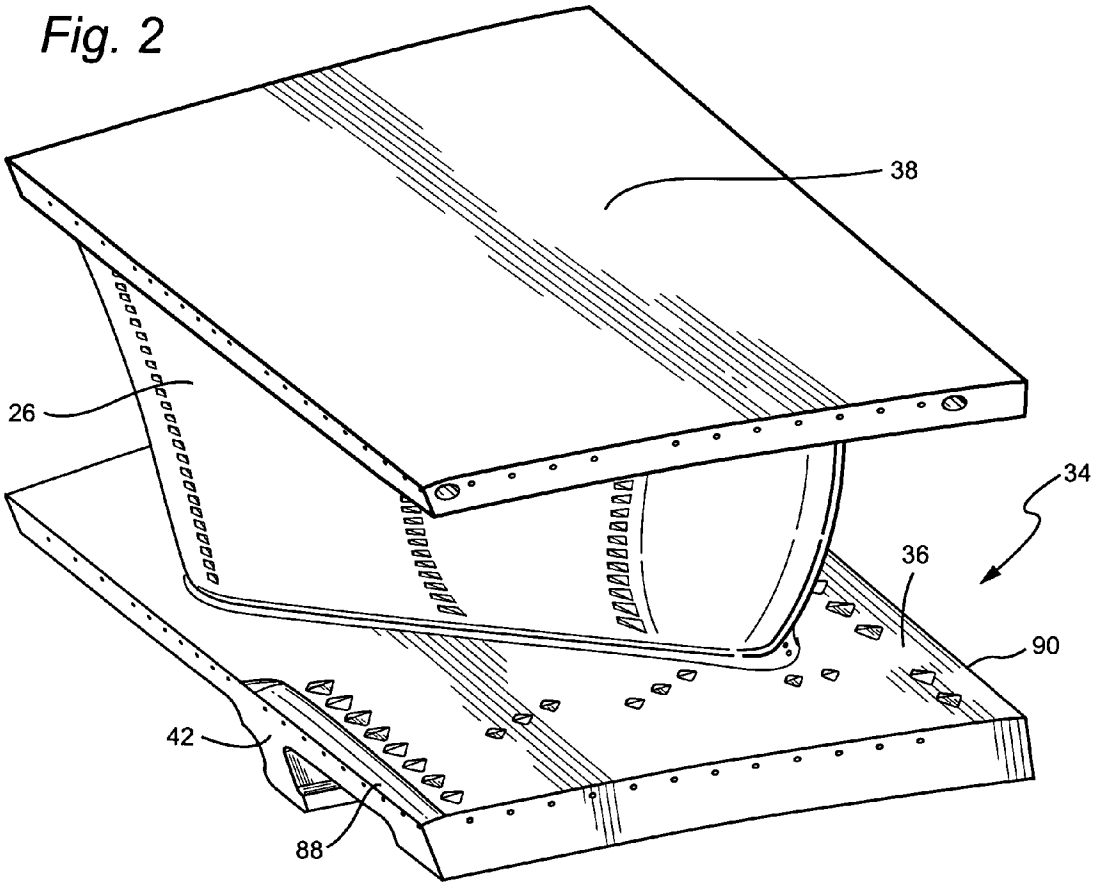
FIG. 2 is a perspective view of a nozzle segment of the stage one nozzle.

Referring to FIG. 2, the first stage nozzles are formed of a plurality of nozzle segments 34, each having an inner platform 36 and an outer platform 38 with at least one nozzle vane 26 extending between the inner and outer platforms. It will be appreciated that the nozzle segments 34 are disposed in an annular array about the axis of the turbine with the opposite edges of each of the inner and outer platforms lying in circumferential registration with adjacent edges of inner and outer platforms, respectively, of adjacent segments. Thus, the opposite edges of the inner platform 36 register circumferentially with adjacent edges of adjacent segments, and hence form an intersegment gap. Similarly, the outer platform 38 has opposite edges which register circumferentially with respective edges of adjacent segments forming intersegment gaps therebetween. As will be appreciated from a review of the drawings, the nozzle intersegment gaps are straight, i.e., generally parallel to the axis of the turbine, enabling removal of the nozzles without removal of the top half of the turbine shell. It will be appreciated that the edges of the platforms, particularly aft of the vane 26 are subject to severe thermal stresses and require an advanced cooling system. The cooling system is symmetrical with respect to the inner and outer platforms and a description of one platform cooling system will suffice as a description of the other platform cooling system.

Figure 4:
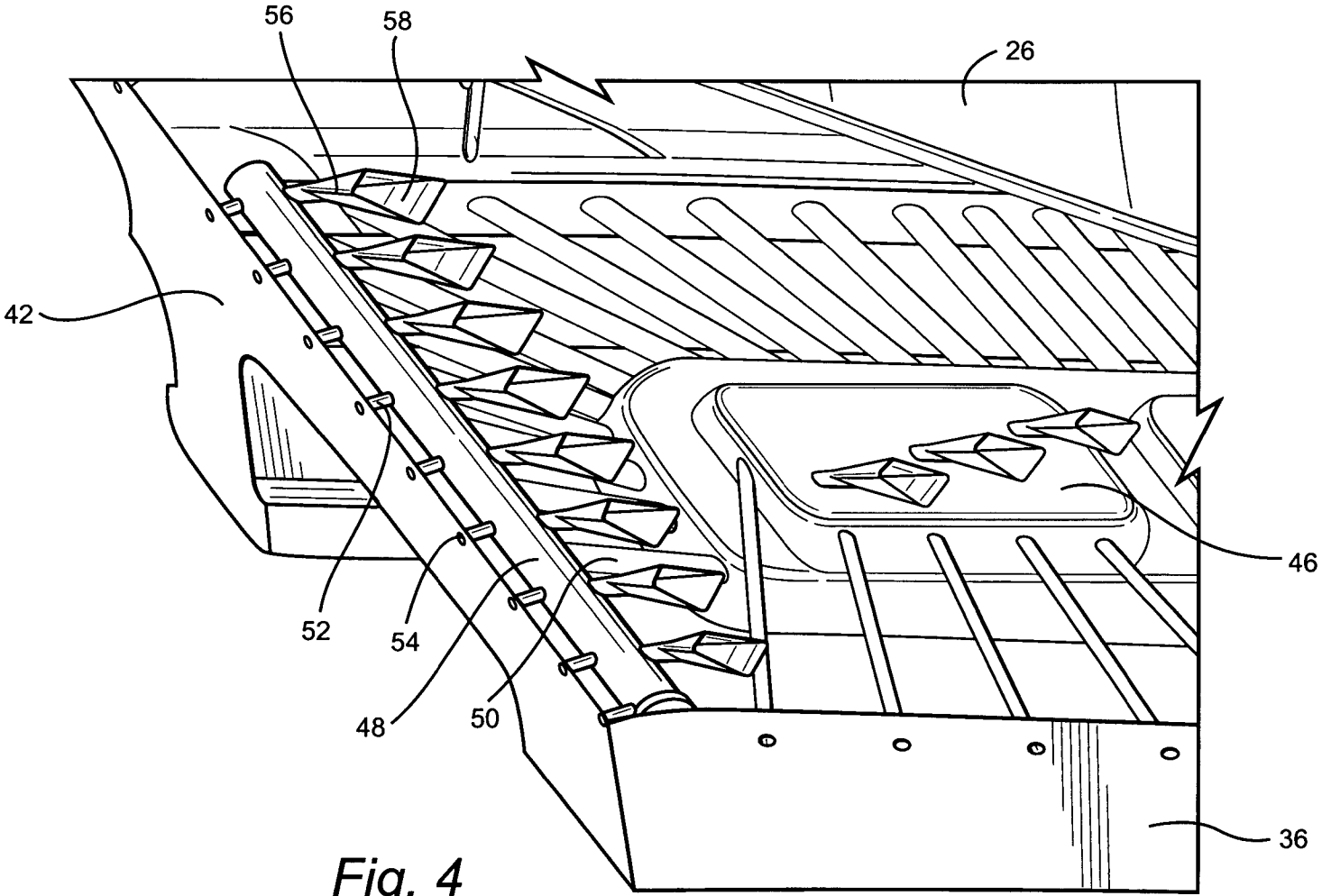
FIG. 4 is a view similar to FIG. 3 with the platform surface removed to illustrate the cooling system within the platform.
Figure 5:
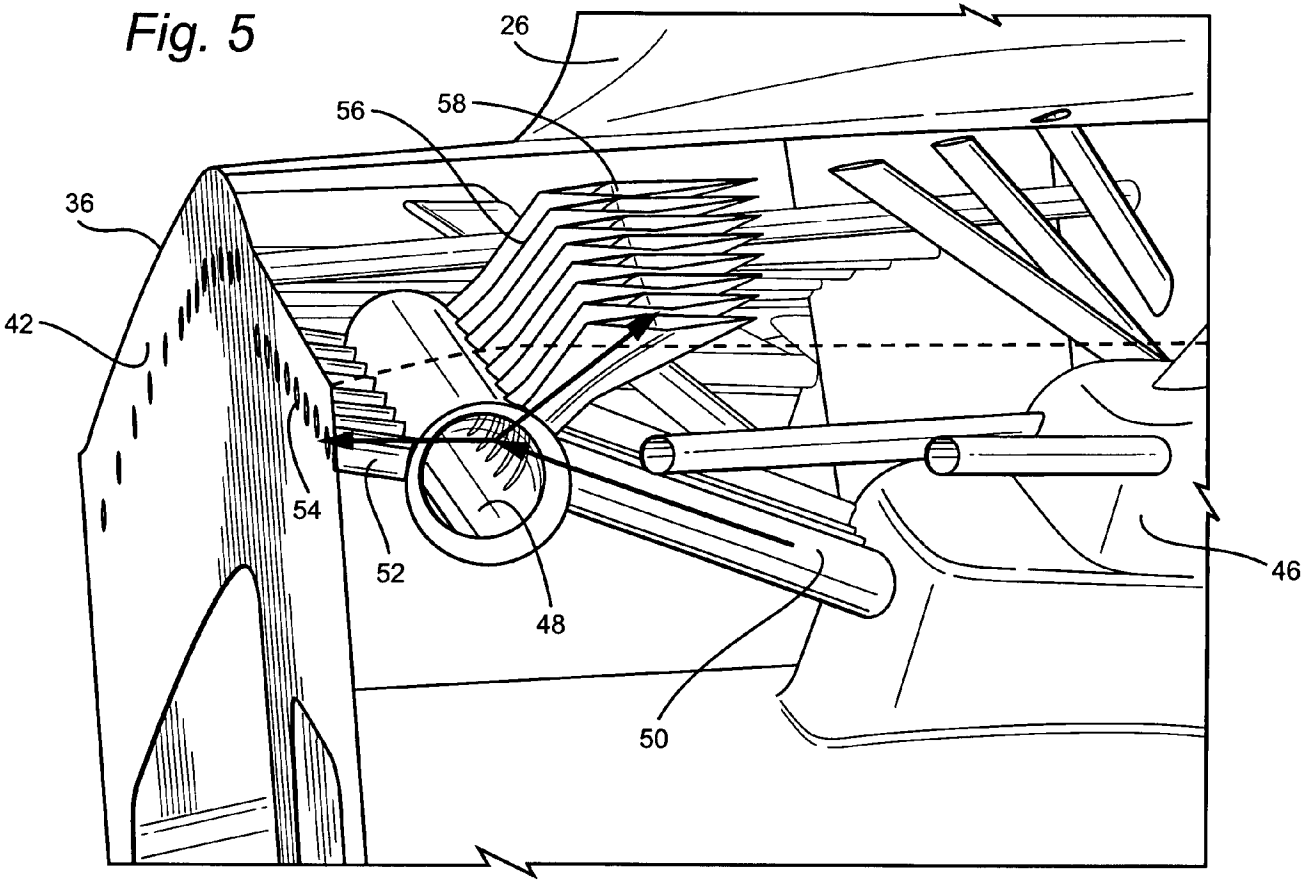
FIG. 5 is a perspective view of the inner platform with the inner platform surface removed to reveal the cooling system.

Referring now to FIGS. 4 and 5, there is illustrated the inner platform 36 having an edge 42 along a suction side of the nozzle segment. That is, the suction and pressure side edges of the platforms refer to the side edges closest to the suction and pressure sides, respectively, of the vane 26. Each platform includes a source of cooling medium, e.g., compressor discharge air, which is supplied to a chamber 46 generally centrally located within the platform. The chamber 46 supplies the cooling medium to various portions of the nozzle and forms part of the present cooling system.

The cooling system hereof includes a first plenum 48 extending generally parallel along the suction side edge 42 of the platform and below the surface of the platform exposed to the hot gas in the hot gas path. The plenum 48 is closed at both ends. The plenum may be integrally cast with the nozzle or may be drilled and plugged at one end. The tapered enlarged ends illustrated in FIGS. 5 and 6 adapt the plenum for receiving a plug, not shown. Plenum 48 is illustrated as circular in cross-section. It will be appreciated that the cross-section of the plenum may be other than circular, e.g., rectilinear or otherwise. A plurality of first inlet passages 50 communicate the cooling medium from the chamber 46 into the plenum 48. The first inlet passages 50 are spaced one from the other and are generally equally spaced along the plenum 48. In this manner, the cooling medium is supplied to first plenum 48 and maintains plenum 48 at a relatively constant pressure throughout the length of the plenum. As illustrated, a plurality of first outlet passages 52 lie in communication with the plenum 48 at spaced locations along plenum 48 and have outlet openings 54 through the side edge 42 of the platform. The outlet passages 52 are generally equally spaced along the plenum and the outlets 54 are likewise equally spaced along the side edge 42 of the platform.

Further, first passageways 56 communicate the cooling medium between the plenum 48 and film cooling holes 58 formed in the surface of the platform for film cooling the surface exposed to the hot gas path. The inlet passages 50, the outlet passages 52 and the passageways 56 are arranged such that the inlet passages 50 do not have direct line-of-sight flow of the cooling medium into the outlet passages 52 and the passageways 56 as the cooling medium flows into the plenum 48. Consequently, impingement cooling of the surfaces of the plenum is effected, affording enhanced internal convective cooling. It will be appreciated that the proximity of the cooling medium in the plenum 48 affords conductive and convective cooling of the side edge 42 of the platform. Additionally, the passages 52 and outlets 54 transmit cooling medium into the intersegment gap, between adjacent platforms, providing cooling of the side edge of the adjacent nozzle. On the suction side of the platform, it will be appreciated that the film cooling holes 58 are arranged to direct film cooling medium generally in the direction of the flow along the platform, i.e., extending in the general direction of the suction side of the vane.

Figure 6:
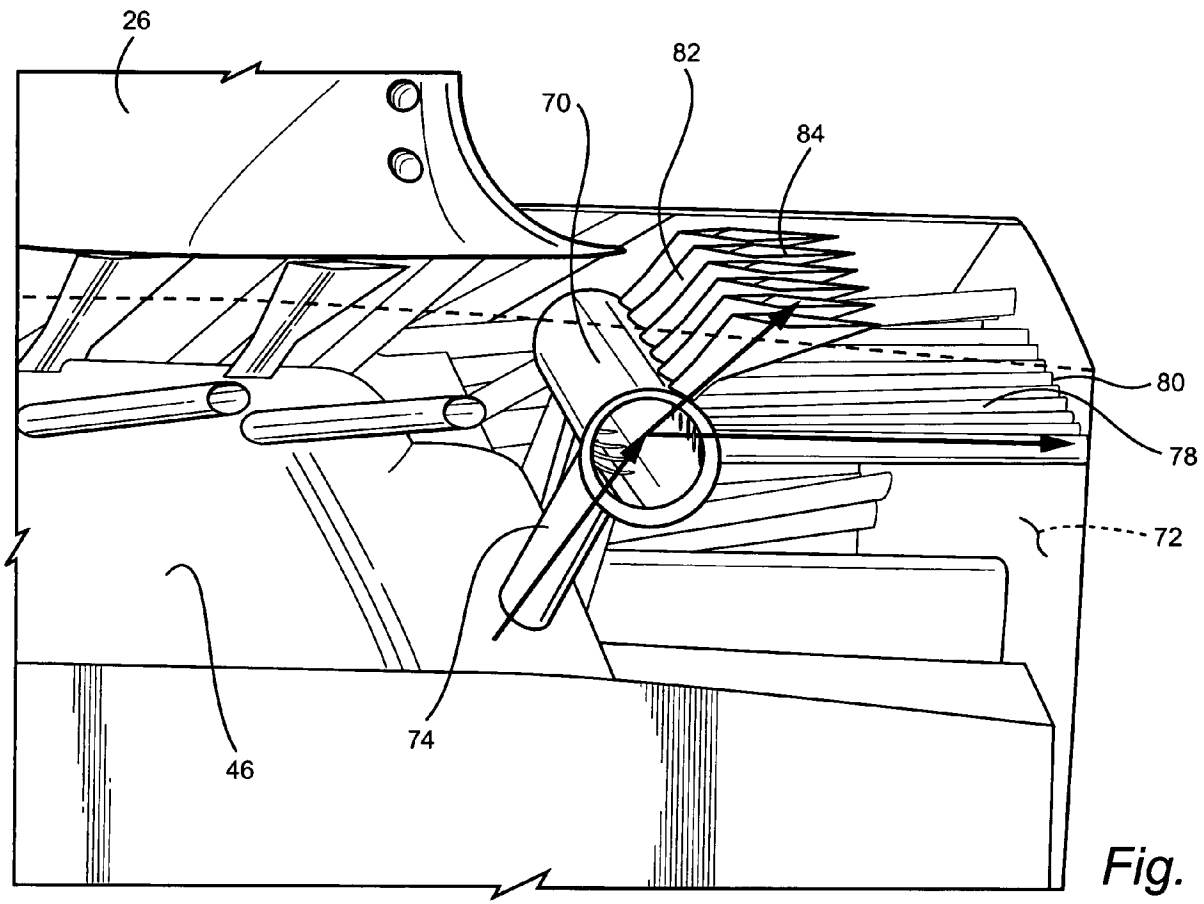
FIG. 6 is a perspective view on the pressure side of the inner platform with the platform surface removed to reveal the cooling system.

Referring to FIG. 6, there is provided a second plenum 70 which extends generally parallel to the opposite side edge 72 of the platform 36, i.e., the pressure side edge 72 of the platform. The plenum 70 is spaced further from the opposite side edge 72 of the platform than the first plenum 48 is spaced from the side edge 42. Plenum 70 is closed at opposite ends and may be configured similar to plenum 48. Similarly as on the suction side, a plurality of second inlet passages 74 lie in communication between the central chamber 46 of the nozzle segment and the second plenum 70 at spaced positions along plenum 70 to supply the cooling medium to the plenum 70 from chamber 46. Likewise, a plurality of second outlet passages 78 communicate cooling medium from the second plenum 70 to second outlet openings 80 along the side edge 72 of the platform. The outlet openings 80 and passages 78 are generally equally spaced from one another. Finally, second passageways 82 lie in communication with the second plenum 70 and a plurality of film cooling holes 84 disposed along the surface of the platform adjacent the pressure side. The film cooling holes 84 are oriented to direct film cooling medium generally in the direction of flow of the hot gases past the vane. Thus, the second film cooling holes 84 direct the cooling medium across the intersegment gap for film cooling a trailing edge portion of the adjacent nozzle segment.

Figure 3:
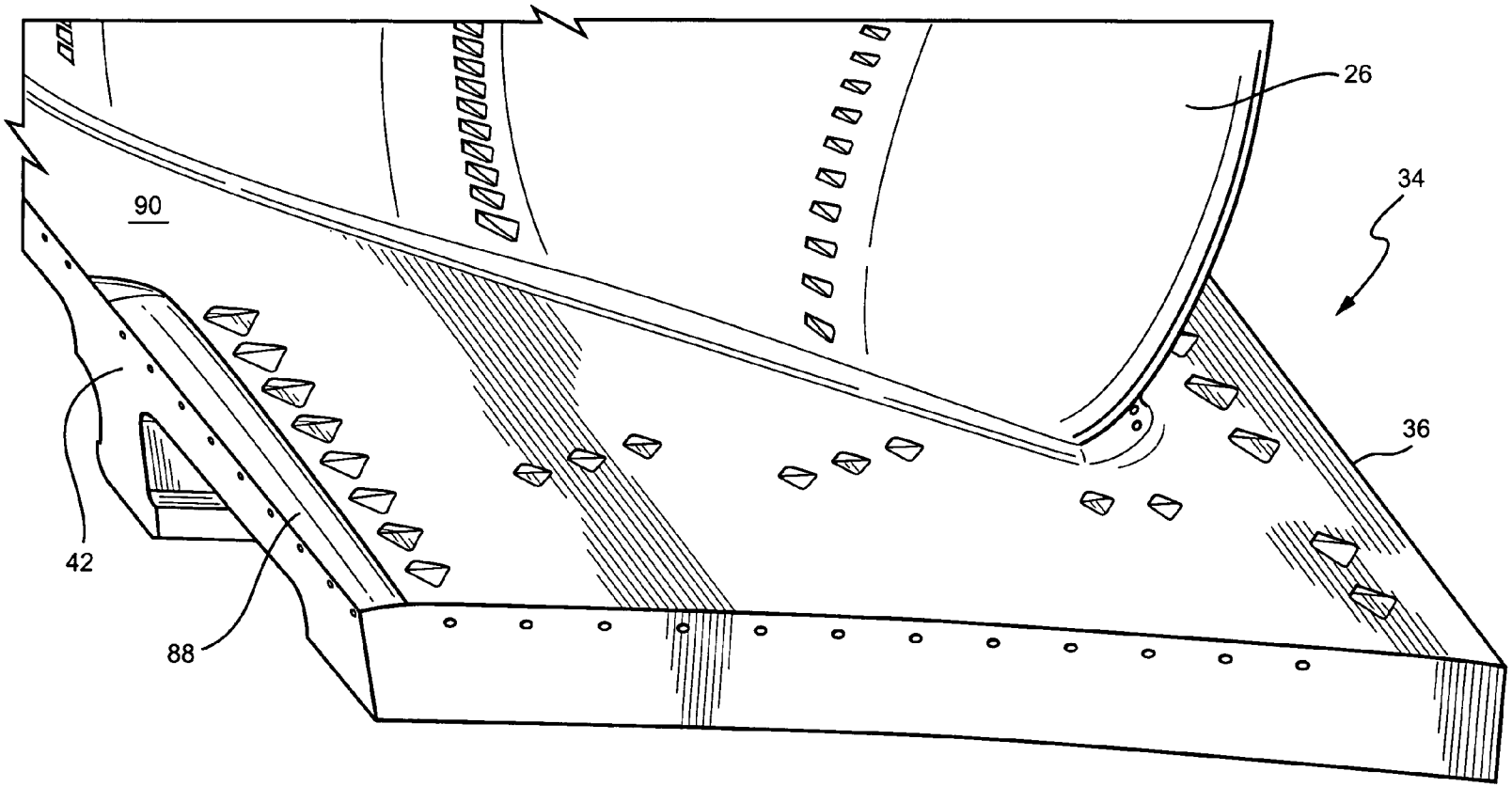
FIG. 3 is an enlarged fragmentary perspective view illustrating opposite side edges of a platform and a vane of a nozzle segment as viewed from the suction side.

To minimize any thermal spike or trip of flow between the pressure side of the platform and the suction side of the adjacent platform, a platform edge portion 88 adjacent the trailing edge and along the suction side edge of the platform is slightly recessed, as in FIGS. 2 and 3, below adjacent portions 90 (FIG. 2) of the platform surface in the hot gas path. Consequently, a trailing edge portion of the platform along the suction side will lie at an elevation equal to or below the elevation of the edge along the pressure side of an adjacent platform, thereby avoiding a thermal spike along the suction side edge and any tripping of the angled flow between adjacent nozzle segments.

With the foregoing cooling scheme, it will be appreciated that the proximity of the cooling medium in the first and second plenums of each platform affords conductive and convective cooling of the edges of the platform. Further, the second film cooling holes 84 afford film cooling along downstream portions of the pressure side of the segment, as well as along the suction side of the adjacent segment. The film cooling holes 58 film cool the platform surface along the suction side of the segment. The first and second cooling holes 54 and 80 lie just under the platform surface exposed to the hot gas path and provide cooling medium into the intersegment gap to cool the edges. Finally, the arrangement of the inlet passages vis-à-vis the outlet passages and passageways is such that direct line-of-sight flow of cooling medium does not occur, and consequently affords enhanced conductive and convective cooling of the edges.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle segment for a turbine having an axis, comprising:

inner and outer platforms and at least one nozzle vane extending therebetween, said platforms having side edges extending generally parallel to the axis;

a cooling system for at least one of said platforms including a source of a cooling medium, a first elongated plenum extending along at least one of the side edges of said one platform, a plurality of inlet passages in communication between said source and said plenum at spaced locations along said plenum, a plurality of outlet passages in communication with said plenum at spaced locations along said plenum and having outlet openings through said one side edge of said one platform at spaced locations therealong, and passageways in communication with said plenum and a plurality of film cooling holes disposed along a surface of said one platform for supplying the cooling medium along and film cooling said platform surface;

said inlet passages, said outlet passages and said passageways being arranged such that said inlet passages do not have direct line-of-sight flow of the cooling medium into the outlet passages and said passageways.

2. A nozzle segment according to claim 1 wherein said vane has pressure and suction sides, said cooling system including a second elongated plenum extending along an opposite side edge of said one platform, a plurality of second inlet passages in communication between said source and said second plenum at spaced locations along said second plenum, a plurality of spaced outlet passages in communication with said second plenum at spaced locations along said second plenum and having second outlet openings through said opposite side edge of said one platform at spaced locations therealong and second passageways in communication with said second plenum and a plurality of second film cooling holes disposed along a surface of said platform for supplying the cooling medium along and film cooling said platform surface;

said second inlet passages, said second outlet passages and said second passageways being arranged such that said second inlet passages do not have direct line-of-sight flow of the cooling medium into the second outlet passages and said second passageways, said first plenum extending along said one side edge on the suction side of said vane being located closer to said one edge of said one platform than the second plenum extending along said opposite side edge on the pressure side of said vane is located relative to said opposite edge of said one platform.

3. A nozzle segment according to claim 1 wherein said vane has pressure and suction side surfaces, said cooling system including a second elongated plenum extending along an opposite side edge of said one platform, a plurality of second inlet passages in communication between said source and said second plenum at spaced locations along said second plenum, a plurality of second outlet passages in communication with said second plenum at spaced locations along said second platform and having second outlet openings through said opposite side edge of said one platform at spaced locations therealong and second passageways in communication with said second plenum and a plurality of second film cooling holes disposed along a surface of said one platform for supplying cooling medium along and film cooling said platform surface;

said second inlet passages, said second outlet passages and said second passageways being arranged such that said second inlet passages do not have direct line-of-sight flow of the cooling medium into the second outlet passages and said second passageways, the first-mentioned film cooling holes being directed to flow the cooling medium along the platform surface for film cooling thereof in a direction generally parallel to the suction side surface of the vane.

4. A nozzle segment according to claim 3 wherein said second film cooling holes are located along said opposite side edge on the pressure side of said vane and are directed to flow the cooling medium along the platform surface for film cooling thereof in a direction toward said opposite edge of said platform.

5. A nozzle segment according to claim 1 wherein said vane has pressure and suction sides, said cooling system including a second elongated plenum extending along an opposite side edge of said one platform, a plurality of second inlet passages in communication between said source and said second plenum at spaced locations along said second plenum, a plurality of second outlet passages in communication with said second plenum at spaced locations along said second plenum and having second outlet openings through said opposite side edge of said one platform at spaced locations therealong and second passageways in communication with said second plenum and a plurality of second film cooling holes disposed along a surface of said platform for supplying cooling medium along and film cooling said platform surface;

said second inlet passages, said second outlet passages and said second passageways being arranged such that said second inlet passages do not have direct line-of-sight flow of the cooling medium into the second outlet passages and said second passageways, said second film cooling holes located along said platform surface on said pressure side of said vane being directed toward said opposite edge of the platform.

6. A nozzle segment according to claim 1 wherein said first plenum is closed at opposite ends.

7. A nozzle segment according to claim 1 wherein said vane has pressure and suction sides, said cooling system including a second elongated plenum extending along an opposite side edge of said one platform, a plurality of second inlet passages in communication between said source and said second plenum at spaced locations along said second plenum, a plurality of second outlet passages in communication with said second plenum at spaced locations along said second plenum and having second outlet openings through said opposite side edge of said one platform at spaced locations therealong and second passageways in communication with said second plenum and a plurality of second film cooling holes disposed along a surface of said one platform for supplying cooling medium along and film cooling said platform surface;

said second inlet passages, said second outlet passages and said second passageways being arranged such that said second inlet passages do not have direct line-of-sight flow of the cooling medium into the second outlet passages and said second passageways, a portion of the surface of said one platform adjacent said one side edge on the suction side of said vane being recessed below remaining surface portions of the one platform.

8. A nozzle segment according to claim 1 wherein said one platform comprises a radially inner platform of said nozzle segment.

9. A nozzle segment according to claim 1 wherein said one platform comprises a radially outer platform of said nozzle segment.

10. A nozzle segment according to claim 1 wherein said outlet passages are substantially equally spaced along said plenum and said one side edge of said one platform.

11. A nozzle segment according to claim 1 wherein said outlet holes are disposed under the platform surface being film cooled.

12. In a turbine having an axis, a plurality of nozzle segments arranged in a circumferential array about said axis, each of said nozzle segments including inner and outer platforms and at least one nozzle vane extending therebetween, said platforms having side edges extending generally parallel to the axis and in generally circumferential registration with the side edges of platforms of adjacent nozzle segments;

a cooling system for at least one of the platforms of each segment including a source of a cooling medium, a first elongated plenum extending along at least one of the side edges of said one platform, a plurality of inlet passages in communication between said source and said plenum at spaced locations along said plenum, a plurality of outlet passages in communication with said plenum at spaced locations along said plenum and having outlet openings through said one side edge of said one platform at spaced locations therealong for flowing the cooling medium toward the side edge of a platform of an adjacent nozzle segment, and passageways in communication with said plenum and a plurality of film cooling holes disposed along a surface of said platform for supplying the cooling medium along and film cooling said platform surface, said inlet passages, said outlet passages and said passageways being arranged such that said inlet passages do not have direct line-of-sight flow of the cooling medium into the outlet passages and said passageways.

13. In a turbine according to claim 12 wherein each of said segments has a vane with pressure and suction sides, said cooling system for each segment including a second plenum extending along an opposite side edge of said one platform, a plurality of second inlet passages in communication between said source and said second plenum at spaced locations along said second plenum, a plurality of second outlet passages in communication with said second plenum at spaced locations along said second plenum and having second outlet openings through said opposite side edge of said one platform at spaced locations therealong for flowing the cooling medium toward a side edge of a platform of another adjacent segment, and second passageways in communication with said second plenum and a plurality of second film cooling holes disposed along a surface of said platform for supplying cooling medium along and film cooling said platform surface, said second inlet passages, said second outlet passages and said second passageways being arranged such that said second inlet passages do not have direct line-of-sight flow of the cooling medium into said second outlet passages and said second passageways.

14. A nozzle segment for a turbine having an axis, comprising:

inner and outer platforms and at least one nozzle vane extending therebetween, said platforms having opposite side edges adjacent respective suction and pressure sides of the vane;

a cooling system for at least one of said platforms including a source of a cooling medium, first and second elongated plenums extending along the opposite side edges of said one platform, a plurality of first and second inlet passages in communication between said source and said first and second plenums, respectively, at spaced locations therealong, a plurality of first and second outlet passages in communication with said first and second plenums, respectively, at spaced locations along said plenums and having outlet openings through respective opposite side edges of said one platform at spaced locations therealong, and a plurality of first and second passageways in communication with said first and second plenums, respectively, and a plurality of film cooling holes disposed along a surface of said one platform for supplying the cooling medium along and film cooling said platform surface;

said first and second plenums extending along respective side edges of said platform adjacent suction and pressure sides of said vane with said first plenum spaced closer to a side edge of said platform on said suction side of said vane than said second plenum is spaced from the side edge of the platform on said pressure side of said vane.

15. A nozzle segment according to claim 14 wherein each of said first and second plenums are closed at opposite ends.

16. A nozzle segment according to claim 14 wherein a portion of the surface of said one platform adjacent the suction side of said vane is recessed below remaining portions of the one platform.

17. A nozzle segment according to claim 14 wherein said one platform comprises a radially inner platform of said nozzle segment.

18. A nozzle segment according to claim 14 wherein said one platform comprises a radially outer platform of said nozzle segment.

* * * * *